United States Patent [19]

Déglon et al.

[11] Patent Number: 4,937,505

[45] Date of Patent: Jun. 26, 1990

[54] ENERGIZING ARRANGEMENT FOR A DISCHARGE LAMP

[75] Inventors: Philippe Déglon; Werner Schneiter, both of Bienne, Switzerland

[73] Assignee: Omega Electronics S.A., Switzerland

[21] Appl. No.: 187,622

[22] Filed: Apr. 28, 1988

[30] Foreign Application Priority Data

Apr. 29, 1987 [FR] France ..... 87 06145

[51] Int. Cl.[5] ..... H05B 41/392

[52] U.S. Cl. ..... 315/307; 315/205; 315/207; 315/224; 315/DIG. 7

[58] Field of Search ..... 315/307, 311, DIG. 7, 315/224, 205, 207

[56] References Cited

U.S. PATENT DOCUMENTS 3,890,537 6/1975 Park et al. ..... 315/208

4,649,322 3/1987 Tellan et al. ..... 315/306

4,766,350 8/1988 Husgen et al. ..... 315/224

4,777,409 10/1988 Tracy et al. ..... 315/307

*Primary Examiner*—Eugene R. LaRoche

[57] ABSTRACT

The discharge lamp energizing arrangement of this invention comprises a starter and a generator adapted to maintain a discharge current in the lamp. The generator includes a first circuit arranged to couple in series a D.C. voltage source, a first switch and a second switch. When the first switch is closed the second is open and vice versa. A second circuit arranged to couple an inductance and the lamp in series is connected in parallel with the second switch. The switches are operated by a control means which combines signals received from an oscillator and a comparator so as to regulate the current flow in the lamp. The generator appears as a source of stabilized current for any load which is applied thereto and may just as well be employed for a lighting fixture as for energizing the luminous points of a matrix display board.

15 Claims, 10 Drawing Sheets starter
4

2
1
3
lamp
$U_5$
6
L
$I_1 = Ti1$
$I_2 = D1$
$U_{RE}$
10 = RE
$U_3$
$V_{BETi2}$
11=Ti2
5
15
12
$U_{CTi2}$
$V_{CETi2}$
14
Vcc
SET
D
D-FF
Q
$\bar{Q}$
RES
CP
Gnd
7
8
-12 V
0V/Φ
$T_1$
$U_1$

ENERGIZING ARRANGEMENT FOR A DISCHARGE LAMP

According to a first embodiment this invention concerns an arrangement for energizing a discharge lamp comprising a first generator capable of furnishing a voltage pulse adapted to trigger the discharge in the lamp and a second generator adapted to maintain a discharge current in the lamp.

This invention likewise concerns, according to a second embodiment, an arrangement for energizing a discharge lamp provided with a first cold electrode and a second electrode having a filament, said arrangement comprising a first generator capable of furnishing a voltage pulse adapted to trigger discharge in the lamp and a second generator adapted to heat the filament during a period of predetermined duration $T_d$, then to maintain a discharge current in the lamp.

This invention further concerns, in accordance with a third embodiment, an energizing arrangement for controlling, responsive to an instruction signal, the luminous intensity of a discharge lamp comprising a first generator capable of furnishing at predetermined periodic intervals $T_r$ voltage pulses adapted to trigger the discharge in the lamp and a second generator adapted to furnish the lamp with a maintenance discharge current in synchronism with each voltage pulse.

BACKGROUND OF THE INVENTION

An arrangement according to the third embodiment has already been set forth in the European patent document No. EP-A-0 152 026 (U.S.-A-4 649 322). In this arrangement triggering of the discharge in the lamp is brought about by a first generator which furnishes voltage pulses at predetermined periodic intervals. The luminous intensity of the lamp is controlled by a current source from a second generator which enables applying a discharge maintenance current to the lamp the duration of application of which may be varied according to the luminous intensity which one wishes to obtain. This arrangement further comprises a circuit which enables application of the maintenance current in synchronism with the voltage pulse.

In addition to two embodiments of the pulse generator, the cited document describes a manner of realizing the generator for maintaining discharge in the lamp. This maintenance generator which is a current source is energized from a DC voltage source and includes essentially two cascaded transistors which conduct continuously when an instruction signal is sent to the input of the first transistor. The duration of the application of the instruction signal (which may be a video signal for instance) determines the period during which the current source conducts, such period being on the order of 14 ms for a lamp giving full luminosity, and being followed by a series of periods of similar duration if the lamp must remain lighted at the full luminosity. In the case wherein the described arrangement is to be adapted in order to bring about simple variations of the luminous intensity of a fluorescent lighting fixture, for instance by means of a manual control, a single pulse furnished by a pulse generator at the moment of lighting of the fixture would be necessary, this pulse being followed by a continuous current maintained at the chosen level.

This manner of operation expends considerable electrical energy which is dissipated as heat and thus as a pure loss. Effectively, it is mentioned in the cited document that an energizing voltage of 60 volts DC enables assuring an arc voltage of about 40 volts in the tube, this leading one to understand that there is a voltage drop on the order of 20 volts which must be absorbed in the current generator. In reality one will note that the arc voltage may vary considerably (10 to 60 volts) depending in this respect on the dynamic program to which the lamp is subjected. The temperature has also an important influence on the value of this arc voltage. Thus, in the arrangement as cited, it is the current generator formed from the two transistors as hereinabove mentioned which must absorb the difference existing between the energizing voltage and the arc voltage, this difference being dissipated as a pure loss as has been mentioned.

The document US-A-3 890 537 describes a chopped energization acting as ballast for a gaseous discharge lamp.

In this document in order to energize the lamp there is employed a mains voltage source having its two alternations rectified. No filter has been provided following rectification. If the energizing system provides as is the case in the present invention, a chopping generator with a transistor and a diode, nevertheless the control of the current in the lamp is effected in a completely different manner to that set forth in the present invention in the sense that in the cited document, each time that the maximum current is attained, one turns off the transistor switch, this switch being turned on again when the minimum current is attained. There results from this a chopping frequency which is variable (between 10 and 40 KHz according to the text of the cited patent). In contrast thereto, the frequency of chopping of the present invention is fixed. If the cutoff of the transistor switch is brought about by a maximum current in the lamp, its reclosing on the other hand is independent of this current. There is thus no need in the present invention for a hysteresis comparator as is the case in the cited invention.

In the present invention thus, the lamp is energized from a DC voltage and from a chopping system having a fixed frequency. In the cited document, this voltage is not rectified and is not filtered and the chopping frequency is essentially variable. This cannot be suitable for energizing luminous points of a large matrix display board where it is necessary to control exactly the states of several neighbouring luminous sources.

It is thus the purpose of this invention to remedy the cited difficulties and to propose an arrangement which is a stabilized current source without itself consuming energy, whatever be the value of the load, such load being here manifested by the arc voltage presented by the lamp which is essentially variable.

SUMMARY OF THE INVENTION

To attain this purpose and according to a first embodiment of the invention, the second generator includes a first electric circuit comprising the placing into series of a first DC voltage source, a first switch and a second switch, said first and second switches being arranged in a manner such that when the first is closed, the second is open and vice versa, and a second electric circuit comprising the placing into series of an inductance and of said lamp connected in parallel across said second switch, said switches being operated by a control means energized by an alternating signal of fixed period $T_1$ provided by an oscillator and means for measuring a value which is representative of current flow in the lamp, in order to compare said representative value to a reference value provided by second DC voltage source $U_3$ and to provide an equality signal when such values are substantially identical, said control means employing said equality signal and placing said first switch initially in a closed state during a first period $T_a$ which extends from the beginning of said fixed period $T_1$ until the appearance of said equality signal, then in an open state during a second period $T_b$ which ends with the ending of said period $T_1$, said first switch being operated according to a cyclic relationship $T_a/T_1$ and controlling the current flow in the lamp.

The same purpose is attained according to the second embodiment of the invention by means identical to those set forth hereinabove to which are added a third switch operated by a second control means said switch enabling to effect successively the energization of the lamp filament, the generation of a voltage surge at the terminals of the lamp and the energization of said lamp in maintenance current.

The same purpose is again obtained according to a third embodiment of the invention by means identical to those set forth with respect to the first embodiment to which are added an arrangement by which the alternating signal of fixed period $T_1$ is applied for a duration $T_c$ which is a function of the instruction signal, said duration of application $T_c$ being comprised in the limits $0 \leqq T_c \leqq T_r$.

The invention will be better understood with the aid of the description to follow and for better understanding of which reference will be made by way of example to the attached drawings.

DESCRIPTION OF THE PREFERRED EMBODIMENTS

Figure 1A:
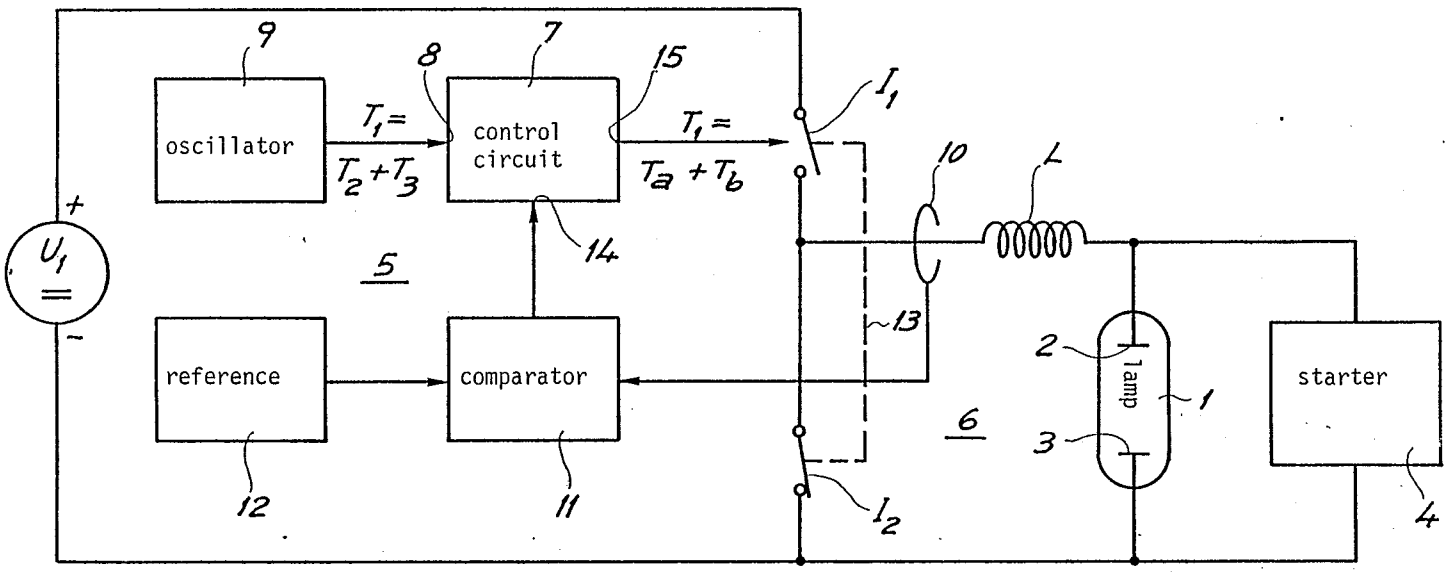
FIG. 1*a* is a general schematic which shows the operation principle of the energizing arrangement for a discharge lamp according to the first, second and third embodiments of the invention.
Figure 1B:
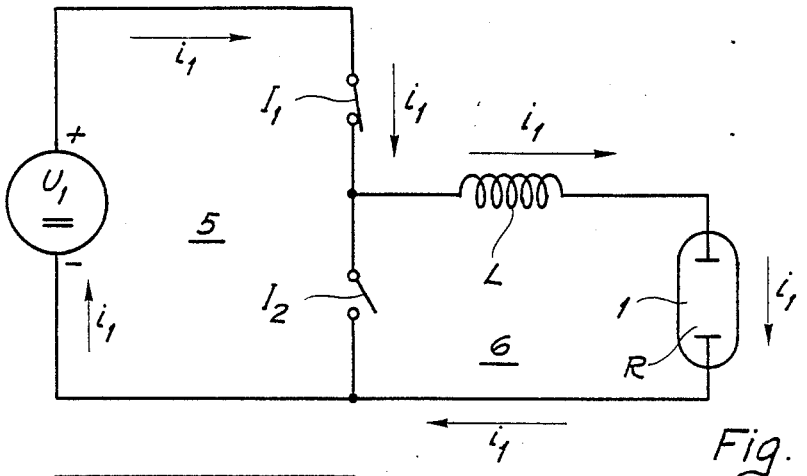
FIGS. 1*b* and 1*c* show the current path in the wiring of the drawing 1*a* according to the position of switches $I_1$ and $I_2$.
Figure 1C:
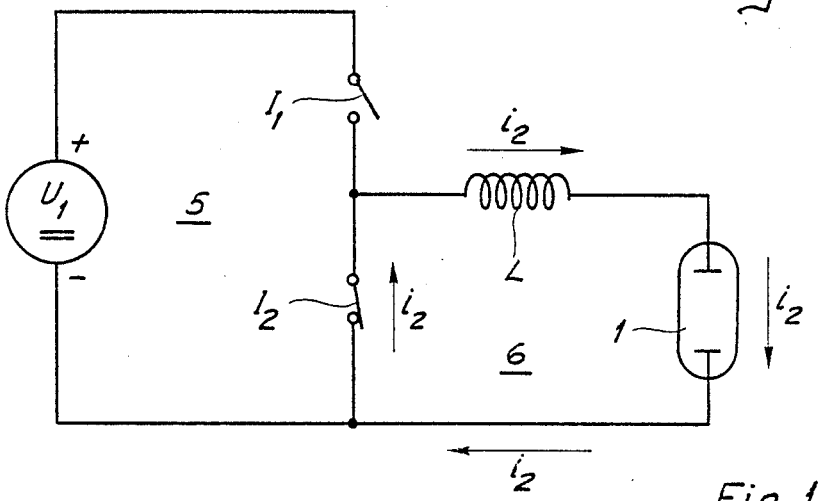

FIG. 1 is a general schematic which shows the basic principle on which the invention depends. A discharge lamp 1 which may be a fluorescent tube is provided with two electrodes 2 and 3. A first generator or starter 4 provides a voltage pulse adapted to trigger discharge in the lamp. It will be seen hereinafter that according to the embodiment of the invention the starter emits a single triggering pulse or on the contrary, repeated pulses at predetermined periodic intervals. The FIG. 1*a* shows further a second generator adapted to maintain the discharge current in the lamp, which second generator is now about to be described and which forms the main object of this invention.

The second generator includes a first electric circuit 5 which comprises the placing into series of a DC voltage source $U_1$ with a first switch $I_1$ and a second switch $I_2$ The switches $I_1$ and $I_2$ are arranged in a manner such that when the first is open, the second is closed and vice versa. This interdependence appears on FIG. 1*a* by the dashed line 13 which couples the respective contact tongues of said switches. The schematic further shows that at the terminals of the second switch $I_2$ is connected a second electric circuit 6 formed by the placing in series of an inductance L and of the discharge lamp 1.

The switch $I_1$ is operated by a control means 7. This means is energized at its input 8 by an alternating signal of period $T_1$ provided by an oscillator 9. It will be subsequently seen that this signal is preferably chosen to be of a high frequency comprised for instance between 150 and 600 KHz. This signal has its natural period $T_1$ composed of an alternation of duration $T_2$ at high level followed by an alternation of duration $T_3$ at low level. The cyclic relationship of this signal is defined as being the ratio $T_2/T_1$. The alternating signal of period $T_1$ is provided by the oscillator 9 and the alternations $T_2$ and $T_3$ have a duration approximately equal.

FIG. 1*a* also shows that the energizing arrangement includes means for measuring a value which is representative of the current flow in the lamp, these means being symbolized by the loop 10 surrounding a conductor in the second electric circuit 6. The representative value of this current is transmitted to a comparator 11 which compares said value to a reference value contained in a block 12. When said values are substantially identical, the comparator 11 emits an equality signal which is introduced into the control means 7 at its input 14 and which is employed by said control means so as to supply at the output 15 thereof in combination with the signal received on the input 8, a control signal for switches $I_1$ and $I_2$. The operation of the arrangement will now be explained having reference to FIGS. 1*b* to 1*d*.

Figure 1D:
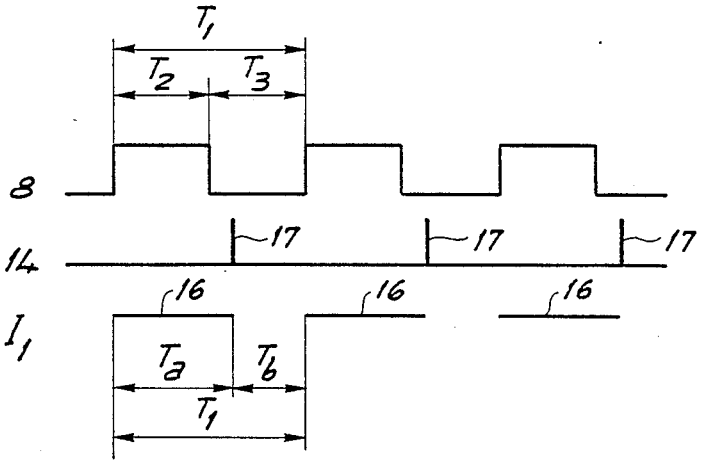
FIG. 1*d* is a simplified timing diagram explaining the operation of the schematics of FIGS. 1*a* to 1*c*.

FIG. 1*d* shows the alternating signal of period $T_1$ present at the input 8 of the control means 7, this signal coming from the oscillator 9. The signal of period $T_1$ is composed of a first alternation at high level $T_2$ followed by a second alternation at low level $T_3$. The control means 7 is arranged in a manner such that when the signal at input 8 goes from the low level to the high level the switch $I_1$ is closed and switch $I_2$ is opened, the switches being maintained in these positions even if the signal applied at 8 goes from the high level to the low level. In the graph shown on FIG. 1*d* the closing of switch $I_1$ is symbolized by the continuous line 16. With $I_1$ closed and $I_2$ open, the electric circuits 5 and 6 are in a state as shown on FIG. 1*b*. The voltage source $U_1$ supplies a current $i_1$ in the inductance L and the lamp 1 via switch $I_1$. In view of the presence of inductance L and the resistance R of the lamp, the current $i_1$ will increase over a period $T_a$ from a value approximating zero up to a value approximately equal to a reference value which is predetermined (block 12, FIG. 1*a*). As soon as this value is attained, the comparator 11 will provide at the input 14 of the control means an equality signal 17 as shown on FIG. 1*d*. This equality signal has the effect of opening switch $I_1$ and closing switch $I_2$. The situation of the electric circuits 5 and 6 is then that shown on FIG. 1*c*. The electrical energy stored in inductance L during the preceding phase then produces a current $i_2$ which, via switch $I_2$, circulates in lamp 1. The inductance L then behaves as a generator. In contrast to the current practice of certain known energizing arrangements, this inductance is not a current limiter but operates as a current reservoir. The current $i_2$ will diminish during a period $T_b$ until there appears a new rise in the signal of period $T_1$ at the input 8 of the control means 7, which signal will again close switch $I_1$. From the end of the period $T_b$ a new cycle begins and continues in a similar manner.

There has just been described the general principle on which the energizing arrangement according to the invention is based. In fact it concerns a stabilized or controlled current source which provides a current of constant value no matter what load is applied thereto. Since this load is a discharge lamp the arc voltage of which, as has been seen, varies over a considerable range, one will always be assured of a constant luminous flux and this without necessitating consumption beyond that which is necessary to produce this luminous flux. Effectively, the switches as described operate in an all or nothing fashion and consume almost no energy of themselves.

Thus in this wiring the current supplied by the arrangement of the invention remains constant whatever be the value of the load. If the load is heavy (R small), the period $T_a$ during which the switch is closed will be likewise small, while if the load is small (R large), this period $T_a$ will be prolonged, the cyclic relationship defined by the expression $T_a/T_1$ controlling in fact the current circulating in the lamp. The arrangement also has the advantage of being resistant to short circuits since in this case the period $T_a$ would be reduced to an extremely short duration, in no case sufficient to damage the voltage source $U_1$.

The basic wiring has been explained by the use of two switches $I_1$ $I_2$ operated by a control means. In practice one will employ a switching transistor in the place of switch $I_1$, such transistor being controlled on its base by the signal coming from the output 15 of means 7. Likewise in practice one will advantageously employ a diode to replace the switch $I_2$, such diode being connected in a manner such that it is non conductive when the transistor is conductive. This diode exhibits the advantage of being self-controlled by the sense of the voltage present at its terminals. It is evident that switch $I_2$ might also be a transistor controlled by the output signal of means 7 and that the invention is not limited simply to the employment of a diode.

In order to measure the current flow in the lamp one will employ advantageously a resistance of low value placed in series in one of the circuits 5 or 6 of the energizing arrangement. For reasons which are essentially practical, one will place this resistance in the first electric circuit 5 and measure the voltage developed at its terminals, such voltage being representative of the current flow in the lamp. Other means however could be practised as for instance the employment of a current transformer placed in the second electric circuit 6.

There will now be described three practical embodiments of the invention, the first and the second applied to a single lighting fixture and the third to a lamp employed to form one of the pixels of a matricial display panel. In both cases there will be explained how the blocks are constructed in FIG. 1*a* which has served to show the principle of the invention.

1. First Embodiment

Figure 2:
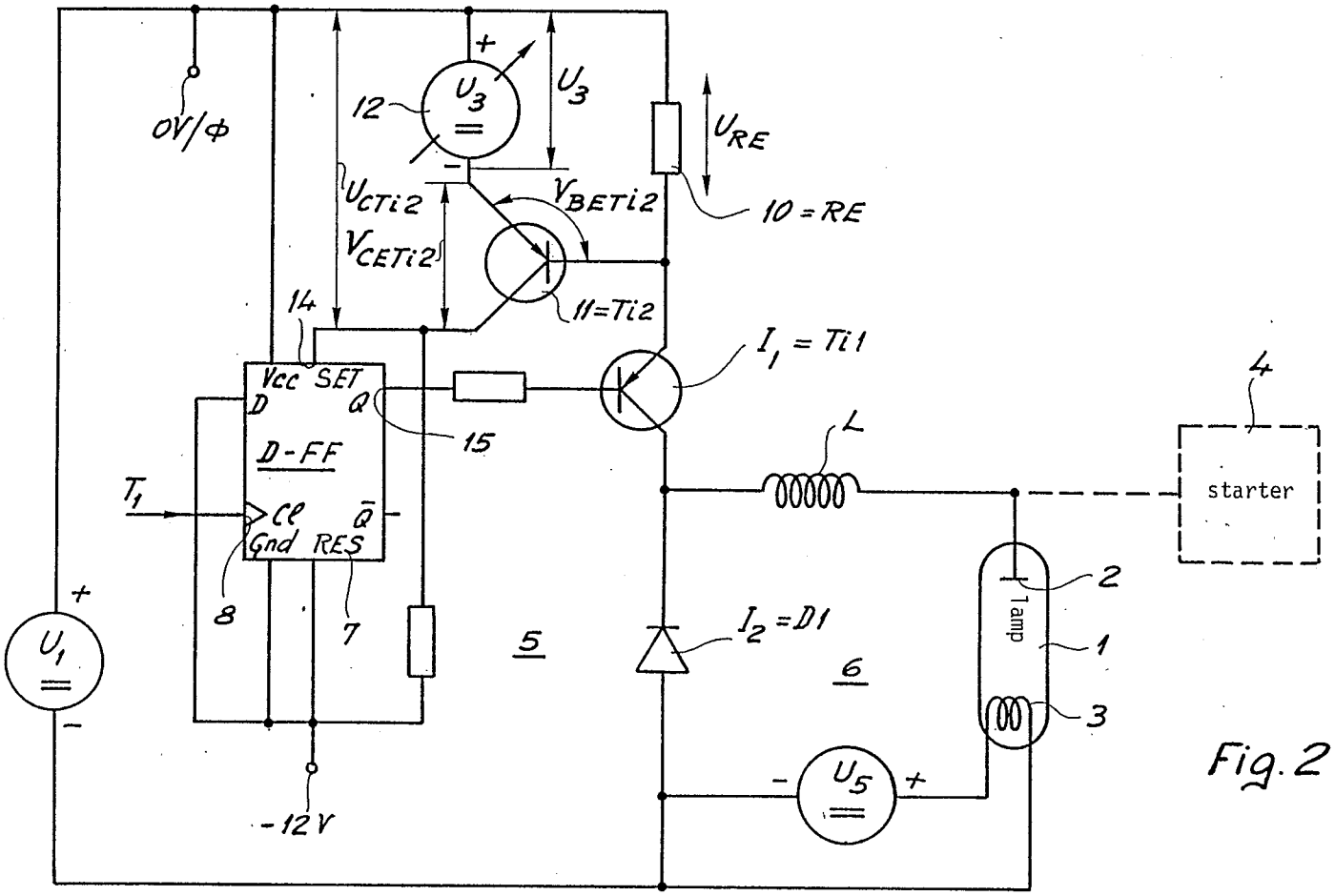
FIG. 2 is a detailed schematic of the energization of a discharge lamp according to the first embodiment of the invention.

The schematic of FIG. 2 shows a first embodiment of the energizing arrangement according to the invention. The control means 7 here is a flip-flop of the D type (D-FF), the terminals D and Reset of which are connected to −12 volts from the energization source of the logic. On its input 8 the flip-flop receives the alternating signal of period $T_1$ here also called clock signal (Cl) or synchronization signal (Sync). The transistor Ti1 is controlled on its base by the output Q of the flip-flop. The collector of the transistor Ti1 is connected to the diode D1 and the emitter to the voltage source $U_1$ via a resistance RE. The voltage $U_{RE}$ developed at the terminals of said resistance RE is compared to a reference voltage $U_3$ by means of a comparator 11 which here is a switching transistor Ti2. At the moment when the voltage $U_{RE}$ is approximately equal to the voltage $U_3$, the transistor Ti2 emits an equality signal which acts directly on the Set input 14 of the flip-flop. The operation of this assembly which has just been described will now be explained having reference to the timing diagram shown on FIG. 3.

To the input 8 of the flip-flop is applied the clock signal Cl which appears on the line a of the diagram. This signal oscillates between −12 V and 0 V (0 V symbolized by the sign ∅), i.e. between the logic values 0 and 1 respectively. This type of flip-flop (for instance Nr. CMOS 4013) has the particularity of matching its output Q to the value applied to its D input when the signal Cl passes from 0 to 1 (arrows 18), the passage from 1 to 0 not effecting any change in the state of the output Q so long as the inputs Set and Reset are both at the zero logic level (−12 V). Since input D is at the logic value 0 (−12 V, line b of the diagram of FIG. 3), the output Q passes from 0 V to −12 V at each positive edge of signal Cl, this being shown on line e of the diagram, the rising flank 18 driving the descending flank 19 from the output Q (arrow 65).

The passage from 0 to −12 V of the output Q has as effect to place transistor Ti1 from the blocked state (switch $I_1$ open) to the conductive state (switch $I_1$ closed). A current $i_1$ begins to flow in the circuit defined by FIG. 1*b*, the rate of increase thereof being limited by the presence of the inductance L (see line f of the diagram of FIG. 3 which represents the current $I_l$ in lamp 1).

Figure 3:
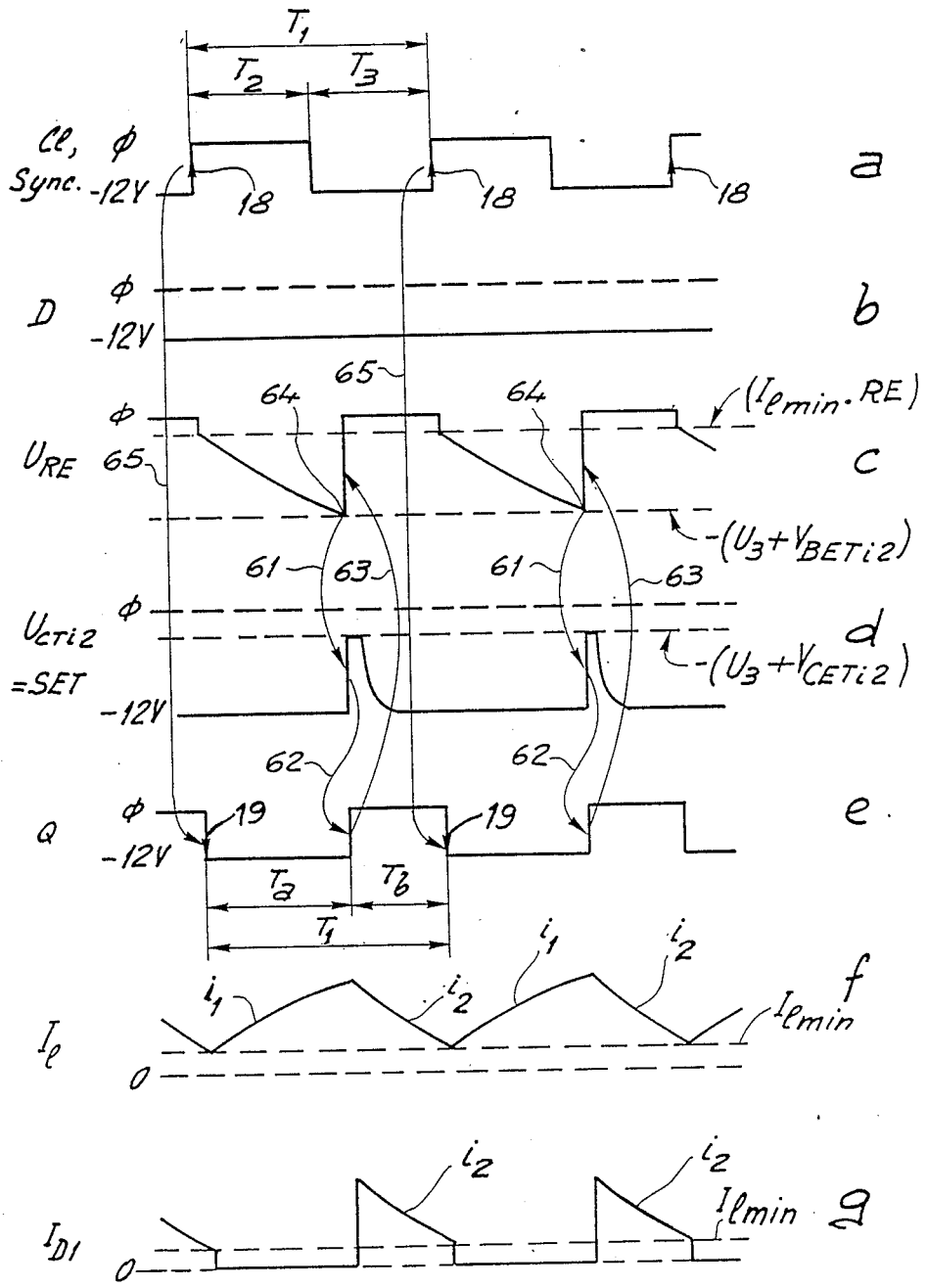
FIG. 3 is a timing diagram explaining the operation of the schematic of FIG. 2.

There will now be observed the voltage $U_{RE}$ at the terminals of the resistance RE and which is represented by line c of the diagram of FIG. 3. This voltage, initially equal to zero when the transistor Ti1 is non conducting, will become more and more negative as soon as such transistor becomes a conductor and this until the instant where it becomes equal to the sum of the voltages represented by the reference voltage $U_3$ and the voltage $V_{BETi2}$ existing between the base and the emitter of the transistor Ti2, i.e. $-(U_3+V_{BETi2})$. At this instant (represented by the point 64 on line c), transistor Ti2 from being a non conductor becomes a conductor and the reference voltage $U_3$, added to that present between the collector and the emitter of Ti2 when it conducts, that is to say $U_{CTi2} = -(U_3+V_{CETi2})$, is brought back to the input 14 (Set) of the flipflop, this having as effect to transform said input Set from −12 V to the indicated value (arrows 61). The signal $U_{CTi2}$ is given by line d of the diagram of FIG. 3.

The rising edge having value $U_{CTi2}$, the final amplitude of which is close to a logic 1, has as effect to switch the flip-flop at its Set input to bring its output Q to 0 V (arrow 62) and to render non conducting transistor Ti1. The voltage $U_{RE}$ passes then from the value indicated on line c to 0 V (arrow 63). From this moment on the energy stored in the inductance L provides a current $i_2$ which flows in the circuit 6 (line f of the diagram of FIG. 3) and which diminishes since there is no longer a voltage source applied thereto. This current $i_2$ will diminish until transistor Ti1 becomes once again conductive, this taking place with the arrival of a new rising edge 18 exhibited by signal $T_1$ at the input Cl of the flip-flop. The cycle which has just been described in detail is then reproduced in the same manner. It will be noted in passing that the increase of voltage $U_{CTi2}$ is followed by a return to −12 V which has no effect on the operation of the arrangement.

Thus, the alternating signal of period $T_1$ applied to the input Cl of the flip-flop and composed of two equal alternations $T_2$ and $T_3$ becomes, seen from the lamp 1, a signal of equal periods $T_1$ but composed of two alternations $T_a$ and $T_b$, the respective durations of which vary relative to one another according to the current imposed on the lamp. The cyclic relationship $T_a/T_1$ then controls the current which flows in the lamp.

The diagram of FIG. 3 has been completed by a line g which represents the current $I_{D1}$ in the diode $D_1$. It will be noted that during the conduction period $T_a$ of transistor $Ti_1$ no current circulates in the diode while during the blockage period $T_b$ of the same transistor a current $i_2$ circulates in said diode.

The diagram of FIG. 3 shows further a threshold current $I_{emin}$ below which the current in the lamp does not drop. This results from the fact that the inductance L is not totally discharged when the cycle $T_1$ recommences. This current explains the first voltage level being found at the terminals of the resistance RE and which has the value ($I_{emin}$.RE).

As an example of a practical embodiment, one may mention that transistors are of the type 2N5400 and the diode of the type lN4148. The voltage source $U_1$ is 60 V and the reference voltage 1.6 V. With a signal having a period $T_1 = 3.2$ μs, a resistance RE of 27 ohms and an inductance of 800 μH, there will be measured a curent peak of 80 mA in the tube (equivalent to about $50mA_{eff}$). Here it will be observed that the inductance employed is of very small dimension (some cubic millimeters) which is another advantage of the arrangement according to the invention. This is mainly due to the fact that the alternating signal of period $T_1$ is chosen to be of high frequency, for instance greater than 150 kHz.

FIG. 2 shows a reference voltage source $U_3$ traversed by an arrow. This latter indicates that the voltage reference may be adjusted, for instance manually by means of a knob, in order to regulate the luminous intensity emitted by the lamp. It will be understood that in varying this voltage one displaces within period $T_1$, the moment at which the equality signal appears at the output of transistor Ti2 and consequently modifies the cyclic relationship $T_a/T_1$ which controls the value of the current in the lamp. In diminishing the value of $U_3$ one diminishes the current in the lamp and consequently its luminosity.

The schematic of FIG. 2 further shows that the discharge lamp employed which is in most cases a fluorescent lamp has a cold anode 2 and a hot cathode 3. This cathode is a filament energized by a DC source $U_5$. Certain considerations on the subject of this energization have been made in document EP-A-0152026 to which reference should be made in order to obtain further details.

To trigger the discharge in a lighting fixture 1, it is sufficient to apply thereto a high voltage pulse at the moment that one turns on the system. This pulse is provided by a starter 4 shown in dotted outline on FIG. 2. This starter may be that which is to be described further on having reference to the third embodiment, but realized in a manner such that it provides only a single high voltage pulse at the moment that the lamp is turned on rather than furnishing repeated pulses.

Figure 6:
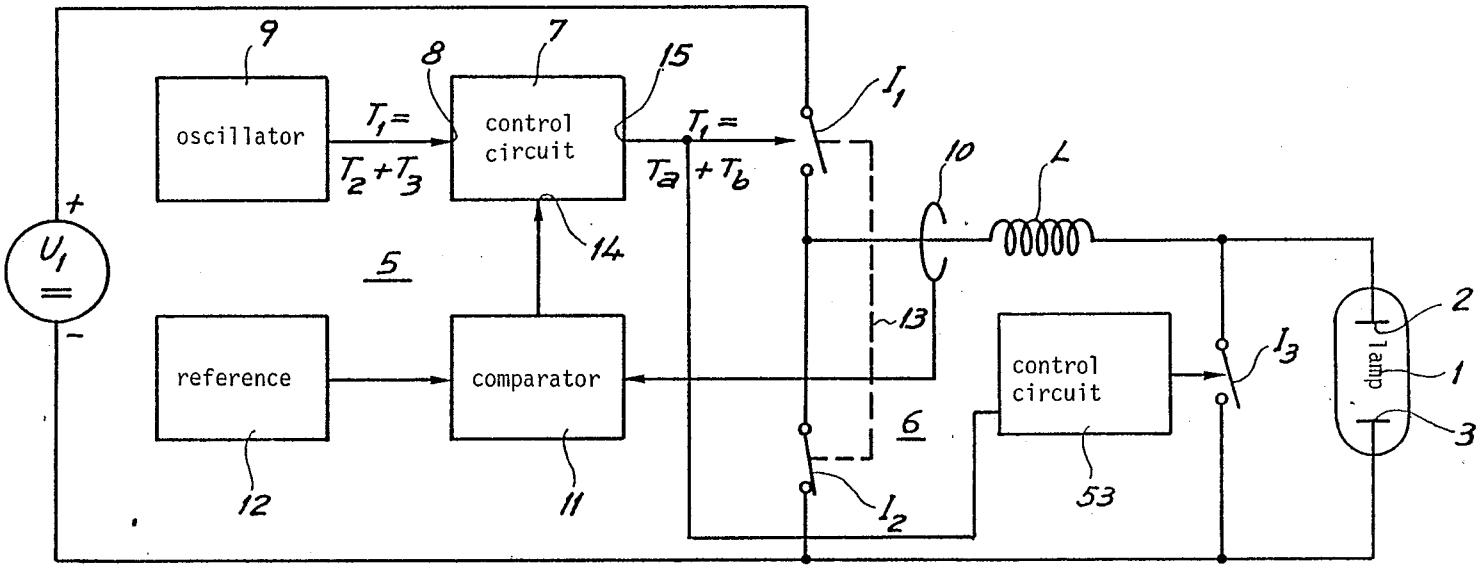
FIG. 6 is a general schematic explaining a possible variant of the first embodiment of the invention as derived from the schematic of FIG. 1*a*.

A possible solution for realizing the starter is shown in the base schematic of FIG. 6 which is a variant of the arrangement shown on FIG. 1*a*. The pulse surge adapted to bring about triggering of the discharge is produced by a third switch $I_3$ connected in parallel over terminals 2, 3 of lamp 1. This switch is controlled by a second control means 53, itself operated by a first control means 7 already described with reference to FIG. 1*a*. The arrangement is such that at the turning on of the energizing arrangement this third switch is closed. Since at this moment the first switch $I_1$ is likewise closed, the inductance L stores energy as has been explained hereinabove. The reopening of switch $I_3$ synchronous with the opening of switch $I_1$ in view of the interdependence of the first and second control means 7 and 53, liberates the energy stored in the inductance and creates the surge required at the terminals of the lamp. A detailed explanation of the operation of the starter will be given during the discussion to be presented in respect of the second embodiment of the invention.

The lamp which is to be ignited has been described in the base schematics 1*a* to 1*c* as possessing two cold electrodes 2 and 3. It is known however that if one of these electrodes can be heated by means of a filament, there will be reduced from 1.5 to 2 times the voltage necessary to trigger the discharge in the lamp. It is also known that a heated- electrode increases considerably the life of the lamp. For this there has been shown on FIG. 2 an electrode 3 provided with a filament energized from a DC voltage source $U_5$. The second embodiment which is now to be described additionally puts to good use the energizing arrangement of the invention in order to heat the filament.

2. Second Embodiment

Figure 7:
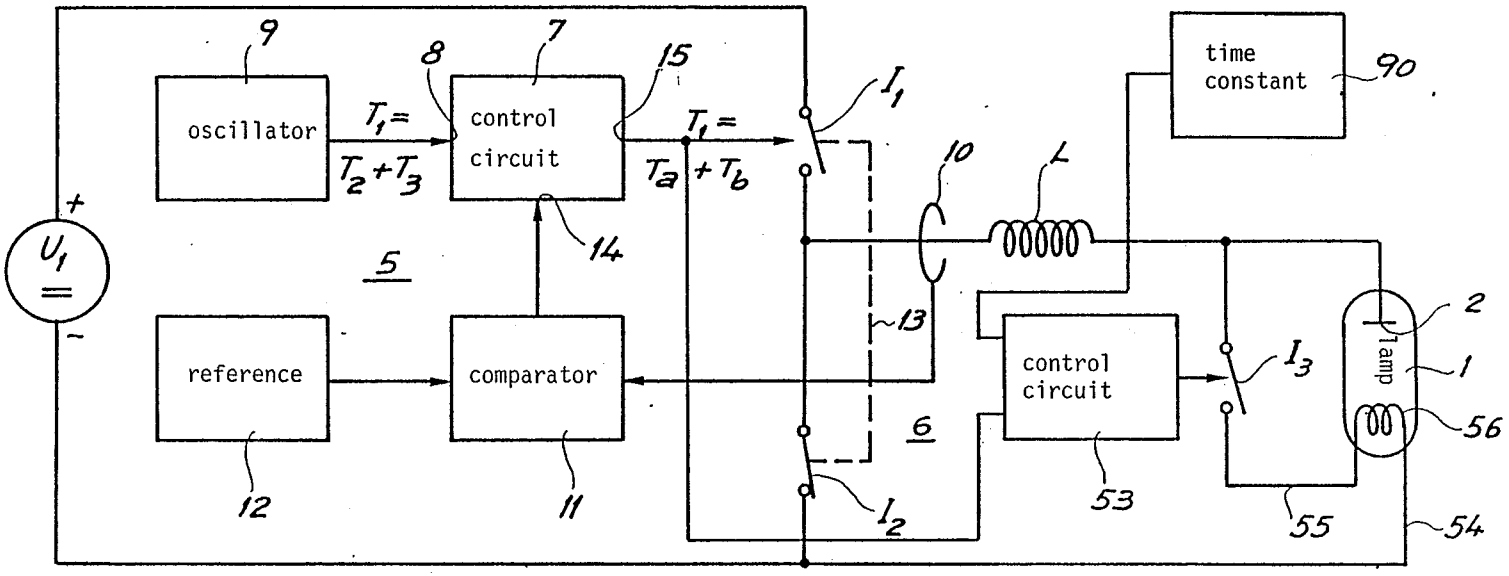
FIG. 7 is a schematic of the operating principle of the energizing arrangement according to the second embodiment of the invention.

The base schematic is shown on FIG. 7. There will be recognized in this schematic the current maintenance generator formed by the first 5 and second 6 electric circuits described hereinabove. Lamp 1 is equipped with a first cold electrode 2 and a second electrode provided with a filament 56. The second generator of this assembly formed of circuits 5 and 6 will serve at the same time for the heating of the filament and for maintaining the discharge in the lamp.

To this end, the second electric circuit 6 comprises placing into series the inductance L, the first cold electrode 2 and a first terminal 54 of the filament 56. This second circuit 6 is connected in parallel across the second switch $I_2$. FIG. 7 further shows a third switch $I_3$ connected on one hand to the cold electrode 2 and on the other hand to a second terminal 55 of the filament 56. The third switch $I_3$ is operated by a second control means 53 itself operated by the first control means 7. The second means 53 is arranged in such a manner that upon turning on the energizing arrangement (by a general switch not shown) the third switch $I_3$ is closed. Filament 56 is then supplied with energy by the second generator 5, 6 according to the same fundamental principle explained hereinabove. The energizing of the filament takes place over a period of predetermined duration $T_d$ fixed for instance by a time constant furnished by the block 90 acting on the input of the second control means 53. This heating period will last for the time necessary to render the filament incandescent, for instance one second. When the heating period as predetermined has run out, the third switch opens, this opening taking place the first time that the first switch $I_1$ passes from the closed state to the open state following the period of predetermined duration $T_d$. This change of state is shown in the form of a logic signal at the output 15 of the first control means 7. This same logic signal acts on the second control means 53 and opens switch $I_3$.As it is found that at the moment of opening of the first switch the energy stored in the inductance L is maximum (see point 64 of FIG. 3*c* corresponding to the current maximum $i_1$ in the lamp according to FIG. 3*f*), the opening of the third switch $I_3$ which is synchronized with the first brings about a surge in the lamp, this surge triggering the discharge. Following this, the third switch $I_3$ remains open and the lamp 1 is energized in maintenance current by the second generator 5, 6.

Figure 8:
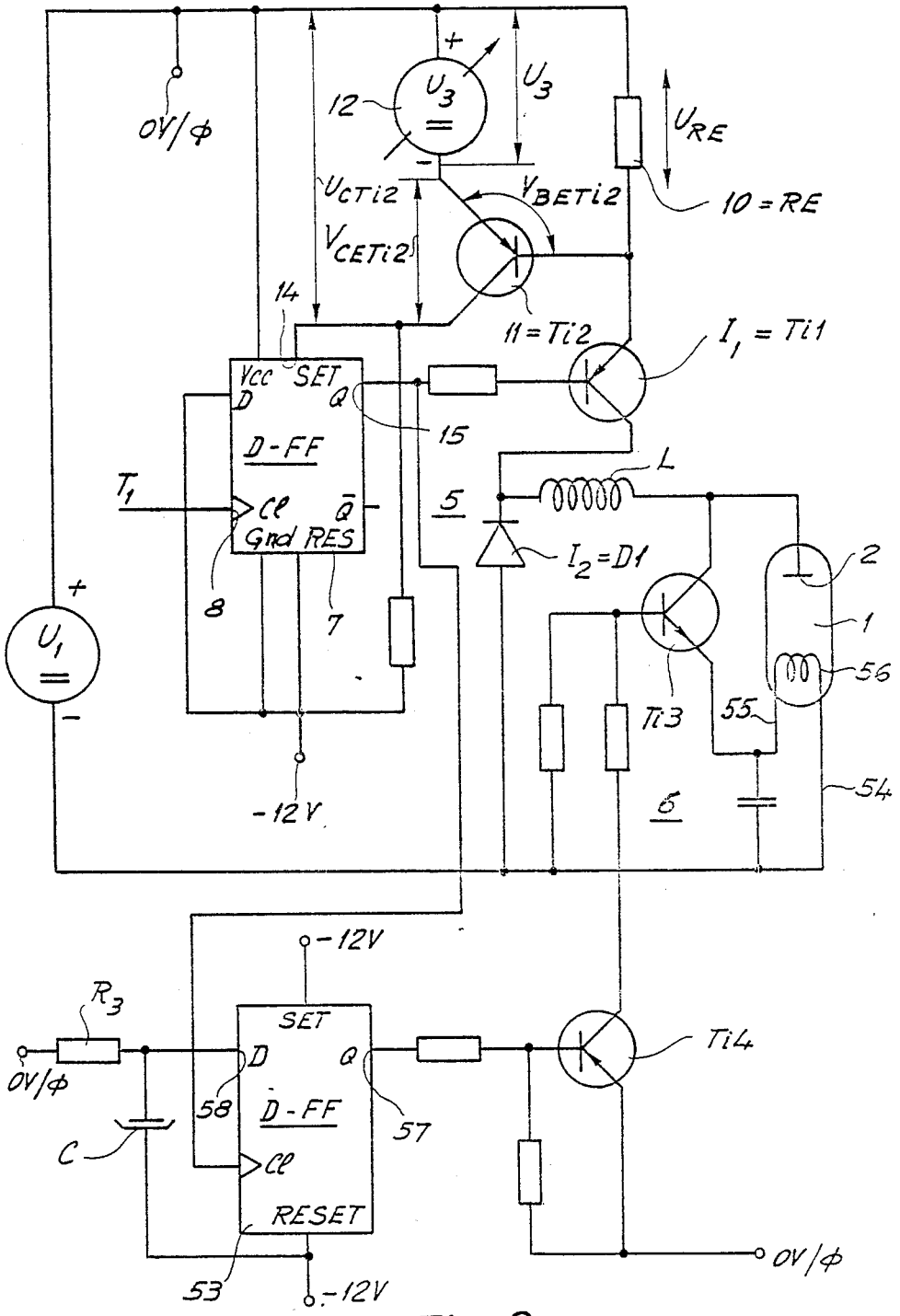
FIG. 8 is a detailed schematic of the energization of a discharge lamp which refers to the schematic of the operating principle of FIG. 7

FIG. 8 is a detailed schematic of the second embodiment, the principle of which has just been explained hereinabove. Here there will be described the elements now added to those of FIG. 2. The third switch $I_3$ is a second transistor Ti3 which is controlled by the signal present at the output Q 57 of the control means 53 which is a second D type flip-flop. The output Q 15 of the first flip-flop 7 is connected to the input Cl of the second flip-flop 53. The D input 58 of the second flip-flop is coupled to 0 volts of the logic energizing source via a resistance $R_3$ and a capacitor C is connected between this input D and the −12 volts of the logic energy source. The terminals Set and Reset of the second flip-flop are likewise coupled to −12 volts. An amplifier-inverter in the form of a transistor Ti4 is interposed between the output Q 57 and the base of the transistor Ti3. It has as purpose to amplify the signal present at the output Q and to invert it at the same time. The second transistor Ti3 has its collector connected to the cold electrode 2 of the lamp and its emitter connected to the second terminal 55 of the filament 56 of such lamp.

Figure 9:
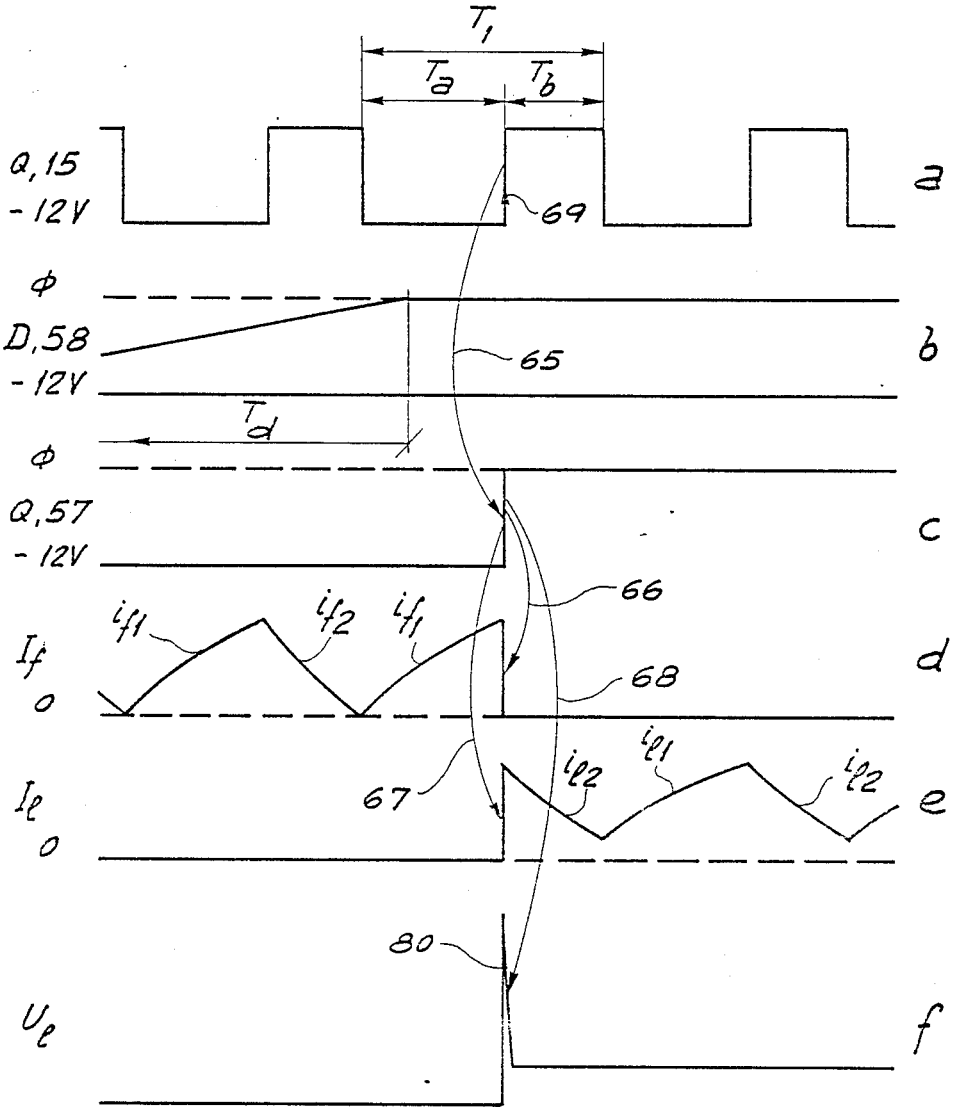
FIG. 9 is a timing diagram explaining the operation of the schematic of FIG. 8.

In order to explain the operation of the circuit of FIG. 8, reference will be made to the timing diagram of FIG. 9.

Upon turning on the system, for instance by means of a switch (not shown), the input D 58 of the flip-flop 53 is at the 0 logic level (−12 V). The output Q 57 of flip-flop 53 is likewise at the 0 level, the transistor Ti4 conducts and furnishes a base current to the transistor Ti3 which likewise conducts. The filament 56 is then under tension and is energized by the same second generator 5, 6 which has been described hereinabove (see FIG. 9*a*). The current $I_f$ in the filament is composed of a succession of currents $I_{f1}$ furnished by the circuit 5 and the currents $I_{f2}$ furnished by the circuit 6 (see beginning of FIG. 9*d*). The lamp 1 is then short circuited by Ti3 and the voltage $U_l$, between the terminals 2 and 55 is zero (see beginning of FIG. 9*f*). After turning on the system, the input D 58 of the flip-flop 53 is brought progressively from −12 V to 0 V and this over a period of predetermined duration $T_d$ which is fixed by the time constant $R_3C$ and which is calculated to be sufficient to bring the filament to incandescence (see beginning of FIG. 9*b*). At the end of period $T_d$, the input D 58 of the second flip-flop is at the level 1 (0 V). At this instant it will be understood that the next rising edge 69 applied to the input Cl of the second flip-flop (and coming from the output Q 15 of the first flip-flop 7) causes the output Q 57 of the second flip-flop (arrow 65) to switch and to pass to 1 (0 V). At this instant transistor switch Ti3 opens and the current $I_f$ in filament 56 is interrupted (arrow 66). The opening of the transistor switch Ti3 brings about a surge 80 (FIG. 9*f*, arrow 68) at the lamp terminals, this surge being due to the energy stored in the inductance L and which is liberated to bring about triggering of the arc. The switching of the output Q 57 of the second flip-flop which brings about opening of the transistor switch Ti3 causes the second generator 5, 6 to energize terminals 2,56 of the lamp by a current $I_e$ (FIG. 9*c* arrow 67) formed as has already been described by an alternation of two currents $I_{e1}$ and $I_{e2}$. Following the voltage surge pulse 80 a maintenance voltage $U_1$ is then established at the terminals of the lamp (end of FIG. 9*f*).

Thus, in this second embodiment, there is employed the same second generator which is the main object of this invention to energize initially the lamp filament during a certain time, then to maintain the arc current in the lamp. This system leads to the employment of means which are much less expensive and cumbersome than the well known heavy ballast which must be presently employed in order to energize fluorescent tubes employed for lighting purposes.

Finally, it will be noted that FIG. 8 depends on a variable source of reference voltage $U_3$ which may be employed in order to vary the luminous intensity of the lamp. This source could be suppressed should this particularly be unnecessary. In such case the emitter of transistor Ti2 would be connected directly to the positive terminal of source $U_1$.

3. Third Embodiment

This third embodiment will be preferably employed to energize discharge lamps forming pixels or elementary luminous points which make up a matrix display panel. The panel may display fixed or animated images in colour or black and white. A manner of energizing the lamps has been set forth in the document cited in the introduction to this description and which bears the number EP-A-0152026 (US-A-4 649 322), such energization having the disadvantage of being expensive in terms of energy consumed and in heat losses as has already been mentioned. Thus one replaces the current source of the cited document by that which forms the object of this invention.

Figure 4:
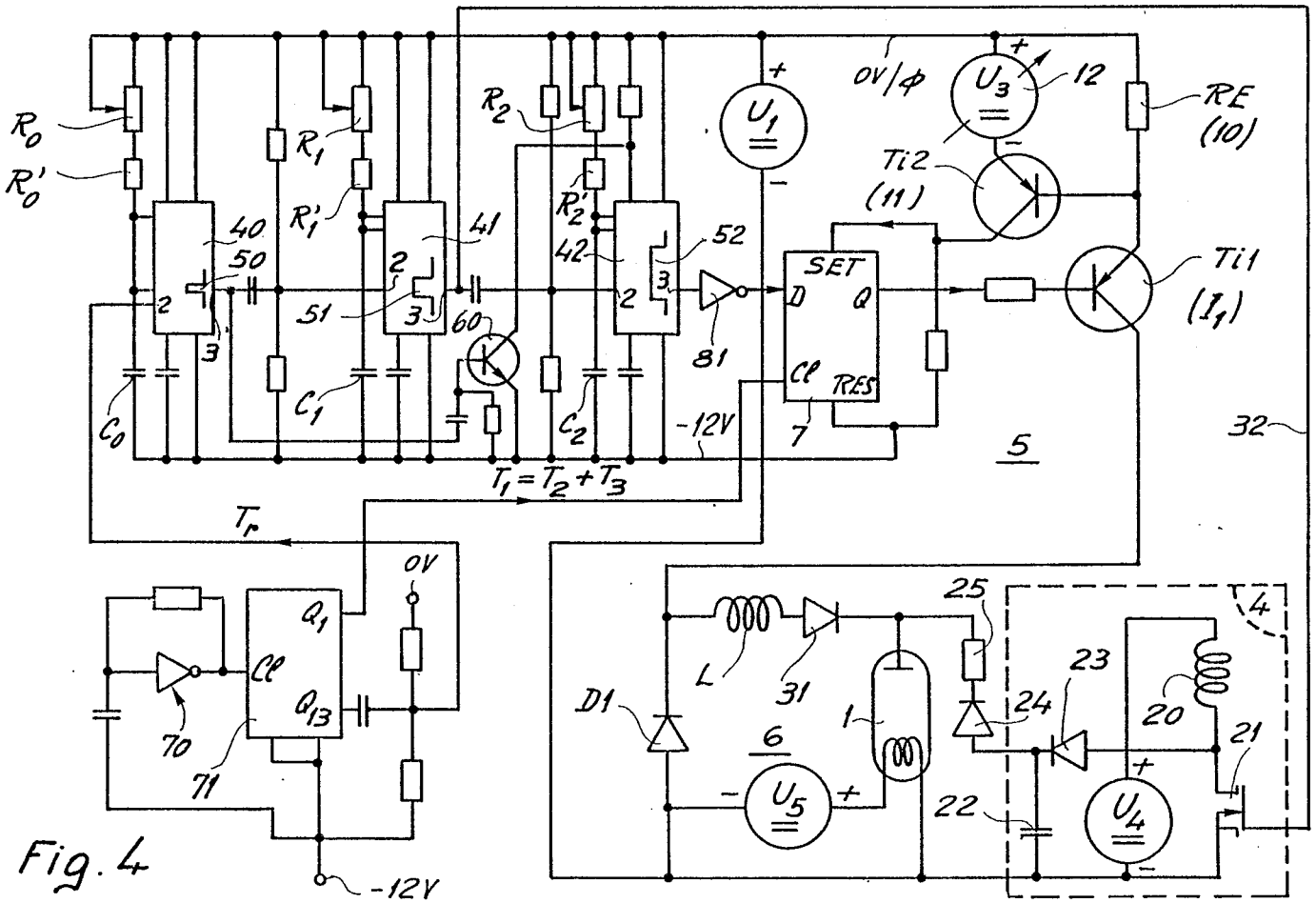
FIG. 4 is a detailed schematic of the energization of a discharge lamp according to the third embodiment of the invention.

In order to do so one may refer to FIG. 4 which presents a detailed schematic of the energization arrangement according to this third embodiment of the invention. In this schematic there will be recognized the current maintenance generator formed by the first 5 and second 6 electric circuits as described in detail hereinabove.

In this third embodiment wherein the luminous intensity of the lamp is regulated as function of an instruction signal (for instance a video signal), the discharge lamp receives voltage pulses at predetermined periodic intervals $T_r$ bringing about triggering of the lamp discharge. These high voltage pulses are furnished by generator 4. Two embodiments of this generator have been described in detail in the document EP-A-0152026. Here there will be briefly recalled the operation of one of the two while mentioning that the other would likewise be suitable in the present case.

Generator 4 is composed of a DC voltage source $U_4$, a winding 20, a switch 21 and a capacitor 22. In such a system the energy accumulated in the winding 20 in the form of current during the conduction period of switch 21 is returned in the form of voltage at the terminals of capacitor 22 when the switch 21 is opened. The value of the stored energy is determined by the voltage $U_4$, the inductance of the winding 20 and the period of accumulation $t_1 - t_0$, $t_0$ representing the instant of closing and $t_1$ the instant of opening of switch 21. The opening and closing signals for the switch 21 are sent over line 32. The surge pulses are applied to the lamp via a diode 24 and a resistance 25. Diode 24 prevents the current source furnished by circuits 5 and 6 from energizing another lamp via the common line from the surge generator if the generator or 4 is employed for several tubes at the same time. The resistance 25 has as purpose to limit the arc current in the tube from the moment when it is triggered. This artifice enables one to assure illuminating of several lamps by means of a single generator. Without this, since the lamps presents different triggering characteristics, only the lamp requiring the lowest voltage pulse would be lighted. Effectively, the voltage present at the terminals of the tube once the arc has been established is clearly smaller than the voltage necessary to trigger it. A substantial current would then flow if no precaution were to be taken. This current would, on the one hand, prevent the triggering voltage from attaining sufficient value to trigger the other tubes and could, on the other hand, bring about the destruction of the first tube which was triggered.

The electric circuit 6 further comprises a diode 31 which prevents the surge voltage furnished by generator 4 to pass back to the discharge current maintenance source.

In synchronism with each surge pulse there is provided a discharge maintenance current to the lamp the duration of which will depend from an instruction signal bearing information indicating the level of luminous flux which is to be attained by the lamp at a given instant. This system, based on the time during which current is appplied and not on its amplitude, is described in detail in the document EP-A 0 152 026 cited hereinabove. One may refer back to this in order to obtain such further information which may be desired.

As in the first embodiment. The second generator according to the invention includes a first electric circuit 5 comprising the placing into series of a DC voltage source $U_1$, a first switch (replaced in FIG. 4 by the transistor Ti1) and a second switch (replaced in the same FIG. by a diode D1 connected in a manner such that is is non conductive when transistor Ti1 is conductive) and a second electric circuit 6 comprising the placing into series of an inductance L and of the lamp 1, this second circuit being connected in parallel across the diode D1. A control means (here flip-flop 7) operates the system. Flip-flop 7 is energized on its input Cl by an alternating signal of period $T_1 = T_2 + T_3$ coming from an oscillator. The oscillator of FIG. 4 is shown at 70, and feeds a frequency divider 71 at its input Cl. The output $Q_1$ provides the desired signal $T_1$ which is found in this example to be the frequency of oscillator 70 divided by two.

In the first embodiment the output of means 7 (Q) provided permanently a signal $T_1 = T_a + T_b$ since the input D of the flip-flop was clamped to $-12$ V of the logic energy source. In this third embodiment on the contrary the signal $T_1 = T_a + T_b$ appears only periodically ($T_r$) and for a duration $T_c$ which is a function of the instruction signal mentioned hereinabove. The signal having duration $T_c$ is applied to the D input of flip-flop 7 and is comprised within limits $0 \leqq T_c \leqq T_r$. When the signal of duration $T_c$ is present at input D, the current source formed by circuits 5 and 6 behaves as in the first embodiment: here one finds effectively the same means to measure the value representative of current flowing in the lamp 1 (RE, 10) in order to compare (11, Ti2) this representative value to a reference value ($U_3$, 12) and to furnish an equality signal (Set) when these values are substantially identical with, as result, a current flow ($i_1$, $i_2$) in two phases of respective durations $T_a$ and $T_b$ as has already been explained.

Figure 5:
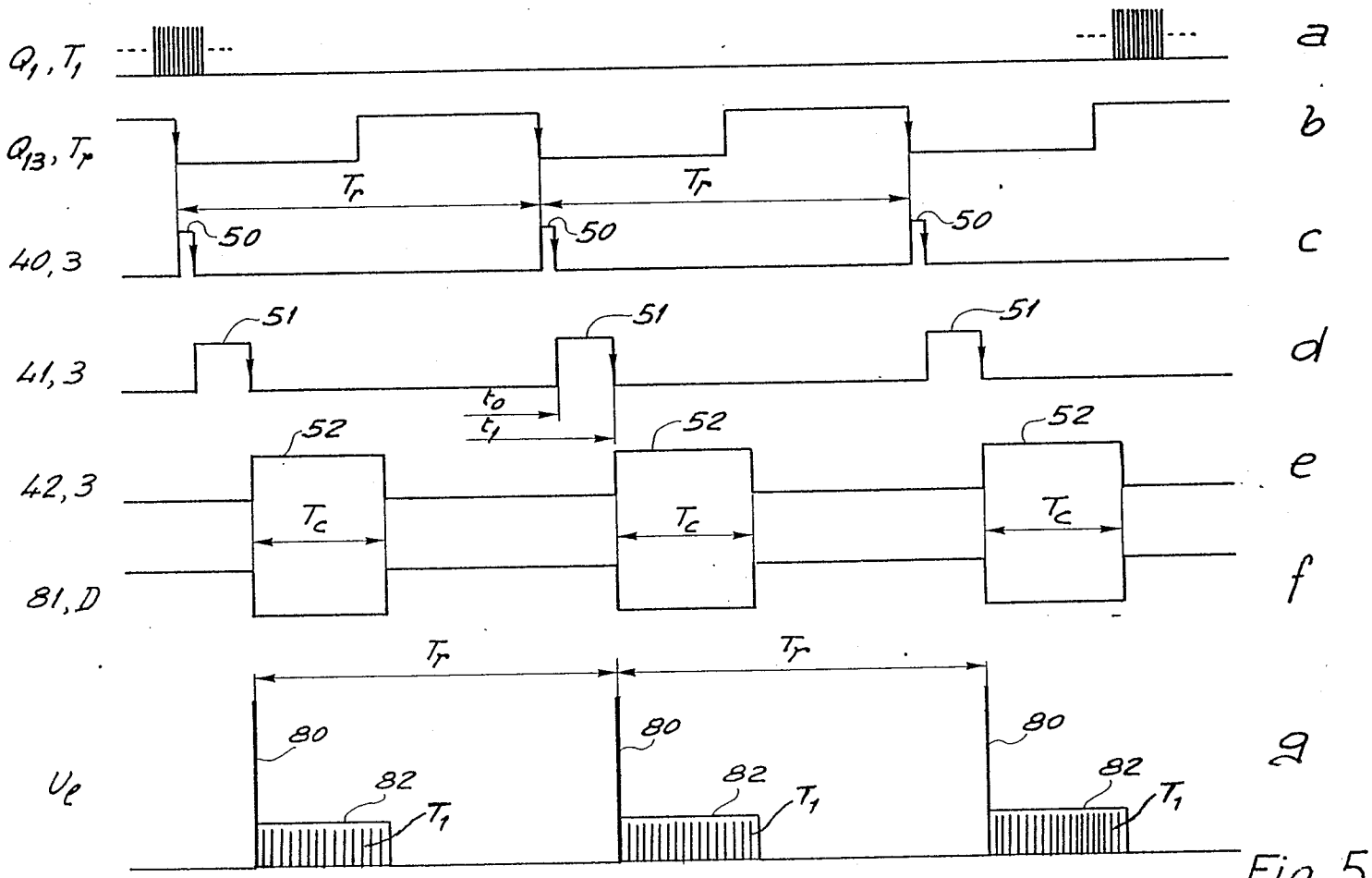
FIG. 5 is a timing diagram explaining the operation of the schematic of FIG. 4.

There will now be explained having reference also to the diagram of FIG. 5 how one goes about, according to one possible method, assuring synchronization of the triggering signal and of the signal for maintaining current in the lamp of duration $T_c$. The arrangement includes the combination of the oscillator 70, divider 71 and three monostable circuits 40, 41 and 42 of the type 555 well known in the state of the art.

One starts with a high frequency oscillator 70. This drives the frequency divider 71 (of the type MC 14020) on the output $Q_1$ of which is found the signal of period $T_1$ for the energization of flip-flop 7 (FIG. 5*a*). A signal of much lower frequency, here equal to the frequency of the oscillator divided by $2^{13}$ is taken off at the output $Q_{13}$ of the divider. Let $T_r$ be the periodicity of this latter signal (FIG. 5*b*). This period $T_r$ represents the rhythm of repetition of the surge pulses.

In the special case where the arrangement described finds its application in the reproduction of animated images coming from a video signal for instance, it will be understood that a point image must be capable of being refreshed or in other terms must be capable of receiving new information at least every 1/25 of a second in the mains supplies at 50 Hz (1/30 of a second in the mains supplies at 60 Hz), which leads to a repetition of the surge pulses every 40 ms. However, this periodicity will be reduced to a third of this value, i.e. to 13.33 ms in order to avoid above all flickering of the image.

The signal of period $T_r$ goes to the input 2 of a monostable circuit 40 which is triggered only on the falling edge of the signal of period $T_r$ in order to furnish at its output 3 a short pulse 50, the width of which depends on the values given to $R_0 + R'_0$ and $C_0$. This width may be varied by adjusting $R_0$ (FIG. 5*c*). The pulses 50 control in turn the circuit 41 which is likewise a monostable device which is triggered on the falling edge of the pulse 50 and prolongs such pulse by a quantity determined by the values given to $R_1 + R'_1$ and $C_1$. It may be adjusted by varying $R_1$. The pulse 51 which results therefrom and which is shown on FIG. 5*d* is gathered at, the output 3 of the circuit 41 and controls via a line 32 switch 21 of generator 4. In this manner one generates the pulse of width $t_1 - t_0$ necessary to create the surge pulse capable of triggering the arc in the lamp, this pulse being represented at 80 on line $5_g$ and repeating itself with the periodicity $T_r$. Pulses 51 control in turn circuit 42 which is again a monostable which is set on the falling edge of the pulse 51 and prolongs such pulse by a quantity determined by the values given to $R_2 + R'_2$ and $C_2$. The pulse 52 of duration $T_c$ which results therefrom and which has been represented on FIG. 5e, is gathered at the output 3 of circuit 42 and controls via inverter 81 the D input of flip-flop 7, this latter controlling, as has been seen the source of maintenance current formed from circuits 5 and 6. The signal present at the D input is shown on FIG. 5f. Pulse 52 or its inversion present at the D input is none other than the instruction signal of duration $T_c$, formed in this example by circuit 42, such circuit operating in synchronism with the triggering generator 4.

It is further necessary to mention with respect to FIG. 4 the presence of the circuit including transistor 60 the purpose of which is to reset to zero the monostable device 42 as soon as there appears at the output 3 of circuit 40 a new pulse 50, this in order to avoid overlapping of the pulse 50 onto a pulse 52 which would not be terminated.

FIG. 5g shows the voltage $U_e$ which appears at the electrodes of the lamp and which is the result of combining of diagrams 5b to 5f. Thus the surge pulse 80 coincides with the falling edge of pulse 51 and the modulation voltage 82 (or of arc maintenance) coincides with the pulse 52.

The practical schematic of FIG. 4 enables varying the intensity of the light by means of a potentiometric regulation ($R_2$) which here is the instruction signal in reality. It is evident that this regulation could be obtained in quite a different manner if the instruction signal were to be information supplied by a television camera for instance. In this case the camera provides at its output an analog signal which is transformed to a digital signal by a converter. Generally, one finds at the output of the converter $2^5 = 32$ possible tones, one of these tones corresponding to the luminous intensity of the point analyzed at this precise moment. These 32 tones result in a practical example from the combination of 128 basic slices of equal duration in order to take into account the sensitivity curve of the eye (see on this subject document EP-A-0 152 025 already cited). The digital information is thereafter sent to a counter which will restore at its output a signal the duration of which corresponds to the luminous intensity analyzed at this moment. Finally, this signal will control a current maintenance source as has already been explained hereinabove.

To give an example of the different signals considered in the third embodiment one may cite:

| | | |
|---|---|---|
| Oscillator 70: | 614.4 kHz | |
| Divider 71, output $Q_1$: | 307.2 kHz | $T_1 = 3.2\ \mu s$, $T_2 = T_3 = 1.6\ \mu s$ $0 \leqq T_a \leqq 3.2\ \mu s$ |
| Divider 71, output $Q_{13}$: | 75 Hz = 614.6 kHz: | $2^{13}\ T_r = 13.33$ ms $0 \leqq T_c \leqq 13.33$ ms |

To end it will be noted that the reference voltage $U_3$ may be adjustable, this permitting an adaption or the emitted luminosity to the ambient light.

What we claim is:

1. An energizing arrangement for a discharge lamp comprising a first generator capable of providing a voltage pulse adapted to trigger discharge in the lamp and a second generator adapted to maintain a discharge current in the lamp, the second generator including a first electric circuit so arranged as to couple in series a first D.C. voltage source, a first switch and a second switch, said first and second switches being arranged in a manner such that when the first switch is closed the second is open and vice versa and a second electric circuit, so arranged as to couple an inductance and said lamp in series, connected in parallel across said second switch, said switches being operated by a first control means energized by an alternating signal having a fixed period $T_1$ provided by an oscillator and means being provided to measure a value representative of the current flow in the lamp in order to compare the representative value with a reference value provided by a second DC voltage source and to furnish a signal indicating equality when said values are substantially identical, said first control means employing the equality signal and placing said first switch initially in its closed state during a first time period $T_a$ which extends from the beginning of said fixed period $T_1$ until appearance of the equality signal then in its open state during a second time period $T_b$ which ends at the end of said fixed period $T_1$ said first switch being operated in accordance with a cyclic relationship $T_a/T_1$ controlling current flow in the lamp said first generator which provides a voltage pulse adapted to trigger discharge in the lamp including a third switch connected in parallel to the lamp terminals and operated by a second control means itself operated by said first control means, said second control means being arranged so that said third switch is closed at the switching on of said energizing arrangement then opens at the first occasion that said first switch passes from the closed state to the open state.

2. An energizing arrangement as set forth in claim 1 wherein the first switch comprises a transistor controlled by the first control means and the second switch comprises a diode connected so as to be non conductive when said first switch is closed.

3. An energizing arrangement as set forth in claim 2 wherein the means for measuring the value representative of the current flow in the lamp are formed by a resistance arranged in series in said first electric circuit.

4. An energizing arrangement as set forth in claim 3 wherein the first control means is a D type flip-flop energized at its clock input by the alternating signal of period $T_1$ and wherein the transistor is controlled on its base by the Q output of said flip-flop, the collector and the emitter of said transistor being connected respectively to the diode and the first voltage source via said resistance, the voltage developed at the terminals of said resistance being compared with said second DC voltage source by means of a comparator, the equality signal from the said comparator acting on the set input of said flip-flop.

5. An energizing arrangement as set forth in claim 4 wherein said second DC voltage source is adjustable.

6. An energizing arrangement for a discharge lamp having a first cold electrode and a second electrode provided with a filament, said arrangement comprising a first generator capable of providing a voltage pulse adapted to trigger discharge in the lamp and a second generator adapted to heat the filament during a period of predetermined duration $T_d$ then to maintain a discharge current in the lamp, said second generator including a first electric circuit arranged to couple in series a first DC voltage source, a first switch and a second switch, said first and second switches being arranged in a manner such that when the first switch is closed the second switch is open and vice versa and a second electric circuit arranged to couple in series an inductance, the first cold electrode and a first terminal of said filament, said second electric circuit being connected in parallel with said second switch, a third switch being connected on the one hand to said first cold electrode and on the other hand to a second terminal of said filament, said first and second switches being operated by a first control means energized by an alternating signal having a fixed period $T_1$ provided by an oscillator, means being provided to measure a value representative of the current flow in the filament and then of the discharge current in the lamp in order to compare said representative value with a reference value provided by a second DC voltage source and to furnish an equality signal when said values are substantially identical, said control means employing said equality signal and initially placing said first switch in a closed state during a first period $T_a$ which extends from the beginning of said fixed period until the appearance of said equality signal, then in an open state during a second period $T_b$ which ends with the ending of said period $T_1$, said first switch being operated in accordance with a cyclic relationship $T_a/T_1$ controlling the current flow in the filament and then in the lamp, said third switch being operated by a second control means itself operated by said first control means and said second control means being arranged in a manner such that said third switches closes with the switching on of the energizing arrangement and then opens after said predetermined period $T_d$, said opening taking place at the first occasion that said first switch passes from the closed state to the open state after said period of predetermined duration.

7. An energizing arrangement as set forth in claim 6 wherein the first switch is a first transistor controlled by the first control means, the second switch is a diode connected in a manner to be non conductive when said first switch is closed and the third switch is a second transistor controlled by the second control means.

8. An energizing arrangement as set forth in claim 7 wherein the means for measuring the value representing current flow in the filament then current flow in the lamp are formed by a resistance arranged in series in the first electric circuit.

9. An energizing arrangement as set forth in claim 8 wherein the first control means is a first D type flip-flop fed at its clock input by the alternating signal of period $T_1$, the first transistor being controlled at its base by the Q output of said first flip-flop, the collector and emitter of said first transistor being connected respectively to the diode and to the voltage source via said resistance, the voltage developed at the terminals of said resistance being compared with said second DC voltage source by means of a comparator, the equality signal from said comparator acting on the set input of said flip-flop, the second control means being a second D type flip-flop fed at its clock input by the signal present on the Q output of said first flip-flop, said period of predetermined duration $T_d$ being present in the form of a signal corresponding to the D input of said second flip-flop and said second transistor being controlled by the signal present at the Q output of said second flip-flop via an amplifier inverter, the collector and emitter of said second transistor being connected respectively to the first cold electrode and to the second terminal of said filament of said lamp.

10. An energizing arrangement as set forth in claim 9 wherein said second DC voltage source is adjustable.

11. An energizing arrangement for controlling the luminous intensity of a discharge lamp in response to an instruction signal comprising a first generator which at predetermined periodic intervals $T_r$ may furnish voltage pulses adapted to trigger discharge in the lamp and a second generator which may furnish the lamp with a discharge maintaining current synchronized with each voltage pulse, said second generator including a first electric circuit arranged to couple in series a first DC voltage source, a first switch and a second switch, said first and second switches being arranged in a manner such that when the first is closed the second is open and vice versa and a second electric circuit arranged to couple in series an inductance and said lamp connected in parallel to said second switch, said switches being operated by a control means energized by an alternating signal of fixed period $T_1$ provided by an oscillator the duration of application $T_c$ of which is a function of said instruction signal, said duration of application $T_c$ being within the limits $0 \leqq T_c \leqq T_r$, means being provided for measuring a value representative of the current flow in the lamp in order to compare said representative value with a reference value provided by a second DC voltage source and to issue an equality signal when said values are substantially identical, said control means employing said equality signal and initially placing said first switch in a closed state during a first period $T_a$ which extends from the beginning of said fixed period $T_1$ until appearance of said equality signal, then in an open state during a second period $T_b$ which ends with the end of said fixed period $T_1$, said first switch being operated in accordance with a cyclic relationship $T_a/T_1$ controlling current flow in the lamp.

12. An energizing arrangement as set forth in claim 11 wherein the first switch is a transistor controlled by the control means and the second switch is a diode connected in a manner such that it is non conductive when the first switch is closed.

13. An energizing arrangement as set forth in claim 12 wherein the means for measuring a value representative of the current flow in the lamp are formed by a resistance arranged in series in the first electric circuit.

14. An energizing arrangement as set forth in claim 13 wherein the control means is a D type flip-flop energized on its clock input by the alternating signal of period $T_1$ and on its D input by the instruction signal of duration $T_c$ and wherein the transistor is controlled at its base by the Q output of said flip-flop, the collector and emitter of said transistor being connected respectively to the diode and the first DC voltage source via said resistance, the voltage developed at the terminals of said resistance being compared with the second DC voltage source by means of a comparator, the equality signal from said comparator acting on the set input of said flip-flop.

15. An energizing arrangement as set forth in claim 14 wherein said second DC voltage source is adjustable.

* * * * *